US007505016B2

(12) United States Patent
Kwon

(10) Patent No.: US 7,505,016 B2
(45) Date of Patent: Mar. 17, 2009

(54) APPARATUS AND METHOD FOR DRIVING LIQUID CRYSTAL DISPLAY DEVICE

(75) Inventor: Kyung Joon Kwon, Seoul (KR)

(73) Assignee: LG Display Co., Ltd., Seoul (KR)

( * ) Notice: Subject to any disclaimer, the term of this patent is extended or adjusted under 35 U.S.C. 154(b) by 246 days.

(21) Appl. No.: 11/646,483

(22) Filed: Dec. 28, 2006

(65) Prior Publication Data

US 2007/0152926 A1 Jul. 5, 2007

(30) Foreign Application Priority Data

Dec. 29, 2005 (KR) ..... 10-2005-0133936

(51) Int. Cl.
*G09G 3/32* (2006.01)

(52) U.S. Cl. ..... 345/87; 345/204

(58) Field of Classification Search ..... 345/82, 345/84, 87, 102, 55, 63, 204, 690; 315/169.1, 315/169.3

See application file for complete search history.

(56) References Cited

U.S. PATENT DOCUMENTS 6,452,582 B1 * 9/2002 Rolston ..... 345/102
7,106,294 B2 * 9/2006 Kumamoto et al. ..... 345/102

* cited by examiner

*Primary Examiner*—David Hung Vu
(74) *Attorney, Agent, or Firm*—Holland & Knight LLP

(57) ABSTRACT

An apparatus for driving a liquid crystal display device includes a liquid crystal display panel having liquid crystal cells in respective regions defined by a plurality of gate and data lines, a data driver providing video signals to the data lines, a gate driver providing scan signals to the gate lines, a timing controller controlling the gate and data drivers, and generates a plurality of dimming signals by resetting a dimming curve in accordance with input data, and a light emitting diode backlight unit driving light emitting diode groups in accordance with the plurality of dimming signals to provide light to the liquid crystal display panel.

21 Claims, 11 Drawing Sheets

| | | | | | |
|---|---|---|---|---|---|
| Avg_1 | Avg_2 | Avg_3 | Avg_4 | Avg_5 | Avg_6 |
| Avg_7 | Avg_8 | Avg_9 | Avg_10 | Avg_11 | Avg_12 |
| Avg_13 | Avg_14 | Avg_15 | Avg_16 | Avg_17 | Avg_18 |
| Avg_19 | Avg_20 | Avg_21 | Avg_22 | Avg_23 | Avg_24 |

FIG. 9

| | | | | | |
|---|---|---|---|---|---|
| Avg_1 | Avg_2 | Avg_3 | Avg_4 | Avg_5 | Avg_6 |
| Avg_7 | Avg_8 | Avg_9 | Avg_10 | Avg_11 | Avg_12 |
| Avg_13 | Avg_14 | Avg_15 | Avg_16 | Avg_17 | Avg_18 |
| Avg_19 | Avg_20 | Avg_21 | Avg_22 | Avg_23 | Avg_24 |

: white

FIG. 10

| | | | | | |
|---|---|---|---|---|---|
| Avg_1 | Avg_2 | Avg_3 | Avg_4 | Avg_5 | Avg_6 |
| Avg_7 | Avg_8 | Avg_9 | Avg_10 | Avg_11 | Avg_12 |
| Avg_13 | Avg_14 | Avg_15 | Avg_16 | Avg_17 | Avg_18 |
| Avg_19 | Avg_20 | Avg_21 | Avg_22 | Avg_23 | Avg_24 |

: white : black

APPARATUS AND METHOD FOR DRIVING LIQUID CRYSTAL DISPLAY DEVICE

This application claims the benefit of the Korean Patent Application No. P2005-133936, filed on Dec. 29, 2005, which is hereby incorporated by reference in its entirety.

BACKGROUND OF THE INVENTION

1. Field of the Invention

The embodiments of the invention relate to a display device, and more particularly, to an apparatus and method for driving a liquid crystal display (LCD) device. Although embodiments of the invention are suitable for a wide scope of applications, it is particularly suitable for partially emphasizing brightness of an image.

2. Discussion of the Related Art

Generally, an LCD device displays an image on an LCD panel by controlling transmittance of light provided from a backlight unit. The LCD panel includes a plurality of liquid crystal cells arranged in a matrix configuration and a plurality of control switches to switch a video signal supplied to the liquid crystal cells. The backlight unit can have a fluorescent lamp as a light source. The trend in backlighting technology is toward smaller, thinner, and lighter backlight units. Based on this trend, light emitting diodes (LEDs) have been proposed as substitute for fluorescent lamps since LEDs have the advantage of low power consumption, light weight, and high brightness.

FIG. 1 is a schematic of an apparatus for driving an LCD device using an LED backlight unit of the related art. As shown in FIG. 1, the related art driving apparatus includes an LCD panel 2 having liquid crystal cells respectively formed in regions defined by n gate lines (GL1 to GLn) and m data lines (DL1 to DLm); a data driver 4 that supplies an analog video signal to the data lines (DL1 to DLm); a gate driver 6 that supplies a scan signal to the gate lines (GL1 to GLn); a timing controller 8 that controls the data driver 4 and the gate driver 6, and generates a dimming signal (DS) using input data (RGB); and an LED backlight unit 10 that generates light from a plurality of LEDs corresponding to the dimming signal (DS) and supplies the light to the LCD panel 2. A thin film transistor array substrate and a color filter array substrate are bonded together with a spacer between the two substrates to maintain a cell gap as well as liquid crystal in the space between the two substrates to form the LCD panel 2.

Liquid crystal cell are defined by the gate lines (GL1 to GLn) and the data lines (DL1 to DLm) on the thin film transistor array substrate. A thin film transistor (TFT) is formed in each of the liquid crystal cells. Each TFT supplies an analog video signal provided from the data line (DL1 to DLm) to a liquid crystal cell in response to the scan signal provided from the gate line (GL1 to GLn). Each liquid crystal cell can be equivalently expressed as a liquid crystal capacitor (Clc) because it is provided with liquid crystal between a common electrode and a pixel electrode connected with the TFT. Each liquid crystal cell also includes a storage capacitor (Cst) that maintains the analog video signal charged on the liquid crystal capacitor (Clc) until the next analog video signal is charged thereon.

The timing controller 8 arranges externally supplied source data (RGB) to be appropriate for the driving of the LCD panel 2, and provides the arranged source data to the data driver 4. Also, the timing controller 8 generates a data control signal (DCS) and a gate control signal (GCS) by using a dot clock (DCLK), a data enable signal (DE), and horizontally and vertically synchronized signals (Hsync and Vsync) externally inputted thereto, and provides the generated control signals to the data driver 4 and the gate driver 6, to thereby control driving timing of the data driver 4 and the gate driver 6. The timing controller 8 also generates the dimming signal (DS) to control the LED backlight unit 10 by using the input data (RGB).

FIG. 2 is a graph illustrating a dimming curve to control an LED backlight unit of the related art. To generate the dimming signal (DS), the timing controller 8 detects the average brightness of the input data (RGB). As shown in FIG. 2, the timing controller 8 then extracts a dimming value corresponding to the detected average brightness (Avg) from a dimming curve (A) set based on the brightness characteristics of the LED backlight unit 10, and generates the dimming signal (DS) based on the dimming value. In FIG. 2, the X axis shows the average brightness (Avg) of the input data (RGB), and the Y axis shows the dimming value corresponding to the dimming curve (A). The dimming curve (A) has an increased dimming value as the gray scale becomes brighter corresponding to the brightness properties of LED backlight unit.

Referring to FIG. 1, the gate driver 6 includes a shift register which sequentially generates the scan signal, that is, a gate high signal in response to the gate control signal (GCS) supplied from the timing controller 8. The gate driver 6 sequentially supplies the gate high signal to the gate lines (GL) of the LCD panel 2 such that the TFT connected with the gate line (GL) is turned-on.

The data driver 4 converts the data signal (Data) provided from the timing controller 8 to the analog video signal in accordance with the data control signal (DCS) supplied from the timing controller 8, and supplies the analog video signal for one horizontal line to the data lines (DL) in one horizontal period for supplying the scan signal to the gate line (GL). That is, the data driver 4 selects a gamma voltage having a predetermined level based on the gray scale value of the data signal (Data), and supplies the selected gamma voltage to the data lines (DL1 to DLm). Then, the data driver 4 inverts the polarity of the analog video signal supplied to the data lined (DL) in response to a polarity control signal (POL).

The LED backlight unit 10 includes an LED array 12 having a plurality of LEDs and an LED controller 14 that drives the LEDs in accordance with the dimming signal (DS) supplied from the timing controller 8. The LED controller 14 generates a pulse-width modulation signal (Vpwm) corresponding to the dimming signal (DS), and provides the generated pulse-width modulation signal (Vpwm) to the LED array 12. The LED array 12 is positioned opposite to the rear surface of the LCD panel 2. The LED array 12 can include a plurality of red, green and blue LEDs arranged repeatedly. The LEDs generate the light in accordance with the pulse-width modulation signal (Vpwm) supplied from the LED controller 14, and then the generated light is applied to the LCD panel 2.

In the above apparatus for driving the LCD device using the LED backlight unit of the related art, the scan signal is supplied to each gate line (GL), and the input data (RGB) is converted into the analog video signal and is then supplied to each data line (DL) in synchronization with the scan signals, to thereby drive the liquid crystal cells. Simultaneously, the plurality of LEDs are driven by the pulse-width modulation signal (Vpwm) corresponding to the dimming signal (DS) in accordance with the average brightness of input data (RGB) from one predetermined dimming curve (A). Accordingly, the apparatus for driving the LCD device using the LED backlight unit of the related art controls the transmittance of light supplied from the LED backlight unit 10 through the liquid crystal cell driven by the analog video signal, to thereby display the image on the LCD panel 2 corresponding to the input data. However, the apparatus for driving the LCD device using the LED backlight unit of the related art has the following disadvantages.

In the apparatus for driving the LCD device using the LED backlight unit of the related art, the dimming signal (DS) is generated based on one predetermined dimming curve (A) from the average brightness of input data (RGB). Accordingly, it is impossible to partially emphasize the brightness of the image displayed on the LCD panel 2 by using the LED backlight unit. Also, the brightness of the LED backlight unit is determined within one predetermined dimming curve (A), which limits variation of brightness in accordance with the input data (RGB), which can cause an unnecessary increase in power consumption.

SUMMARY OF THE INVENTION

Accordingly, embodiments of the invention are directed to an apparatus and method for driving an LCD device, which substantially obviates one or more problems due to limitations and disadvantages of the related art.

An object of embodiments of the invention is to provide an apparatus and method for driving an LCD device that can partially emphasize a brightness of image.

Additional advantages, objects, and features of embodiments of the invention will be set forth in part in the description which follows and in part will become apparent to those having ordinary skill in the art upon examination of the following or may be learned from practice of embodiments of the invention. The objectives and other advantages of embodiments of the invention may be realized and attained by the structure particularly pointed out in the written description and claims hereof as well as the appended drawings.

To achieve these objects and other advantages and in accordance with the purpose of the invention, as embodied and broadly described herein, an apparatus for driving a liquid crystal display device includes a liquid crystal display panel having liquid crystal cells in respective regions defined by a plurality of gate and data lines, a data driver providing video signals to the data lines, a gate driver providing scan signals to the gate lines, a timing controlling the gate and data drivers, and generates a plurality of dimming signals by resetting a dimming curve in accordance with input data, and a light emitting diode backlight unit driving light emitting diode groups in accordance with the plurality of dimming signals to provide light to the liquid crystal display panel.

In another aspect of the present invention, a method for driving a liquid crystal display device with a liquid crystal display panel having liquid crystal cells formed in respective regions defined by a plurality of gate and data lines includes generating a plurality of dimming signals by resetting a dimming curve in accordance with input data, supplying scan signals to the gate lines, and converting the input data into video signals and then supplying the video signals to the data lines in synchronization with the scan signals, and driving a plurality of light emitting diode groups in accordance with the plurality of dimming signals to provide light to the liquid crystal display panel.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIGS. 9 to 11 are exemplary views of illustrating images to reset a dimming curve by the dimming curve setting unit of FIG. 5;

DETAILED DESCRIPTION OF THE INVENTION

Reference will now be made in detail to the preferred embodiments of the invention, examples of which are illustrated in the accompanying drawings. Wherever possible, the same reference numbers will be used throughout the drawings to refer to the same or like parts. Hereinafter, an apparatus and method for driving an LCD device according to embodiments of the invention will be explained with reference to the accompanying drawings.

Figure 1:
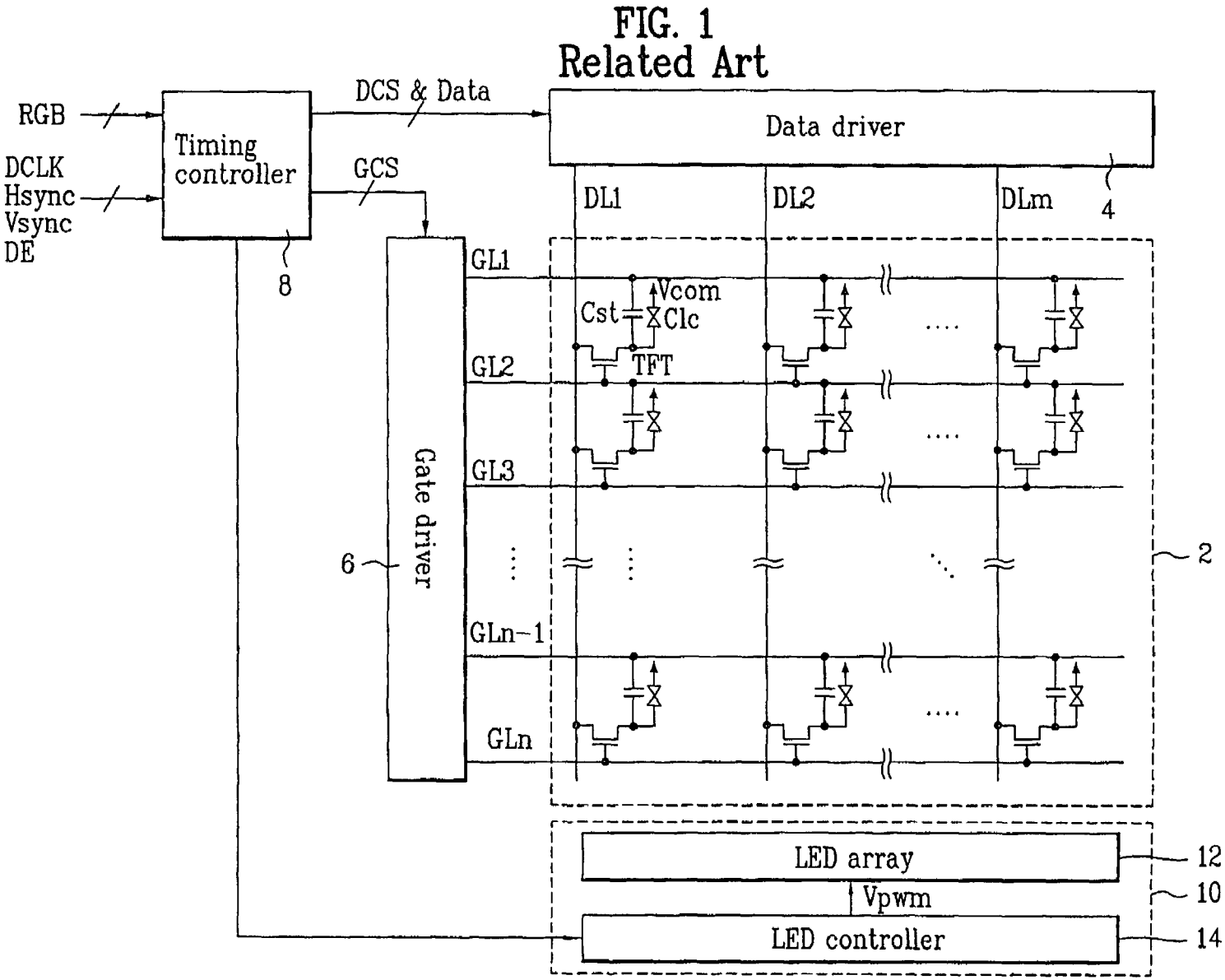
FIG. 1 Related Art
FIG. 1 is a schematic of an apparatus for driving an LCD device using an LED backlight unit of the related art.
Figure 2:
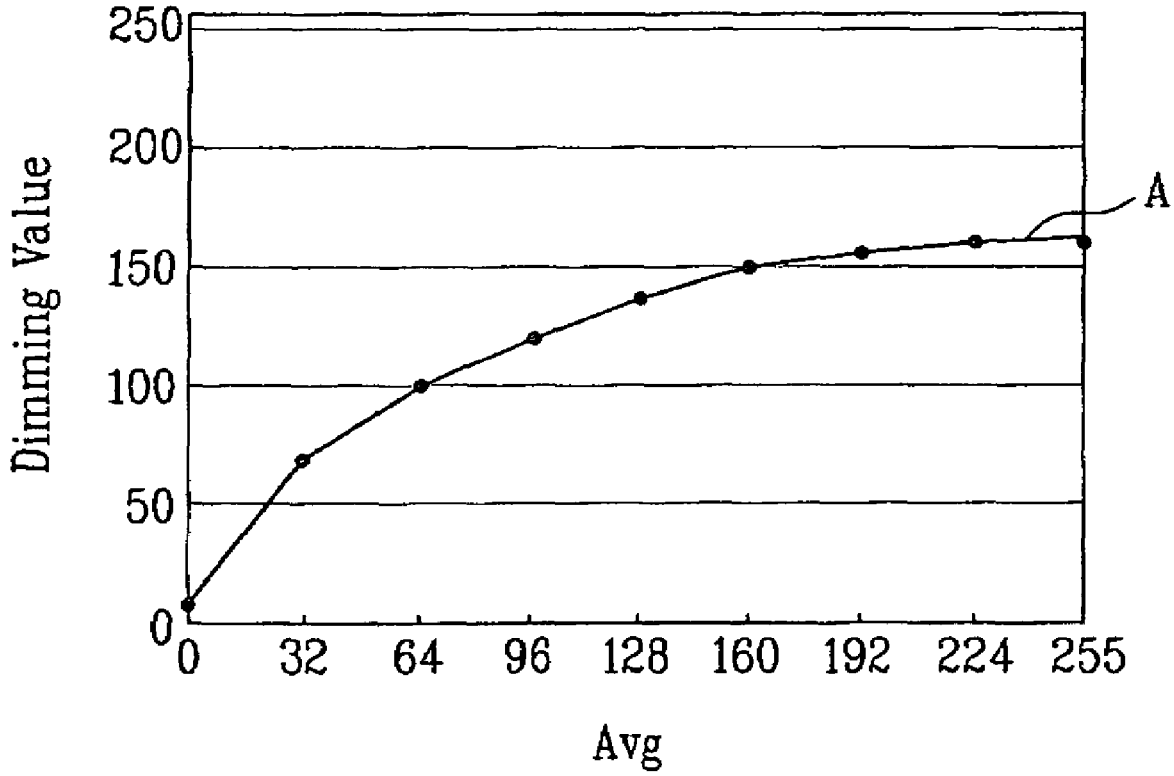
FIG. 2 Related Art
FIG. 2 is a graph illustrating a dimming curve to control an LED backlight unit of the related art.
Figure 3:
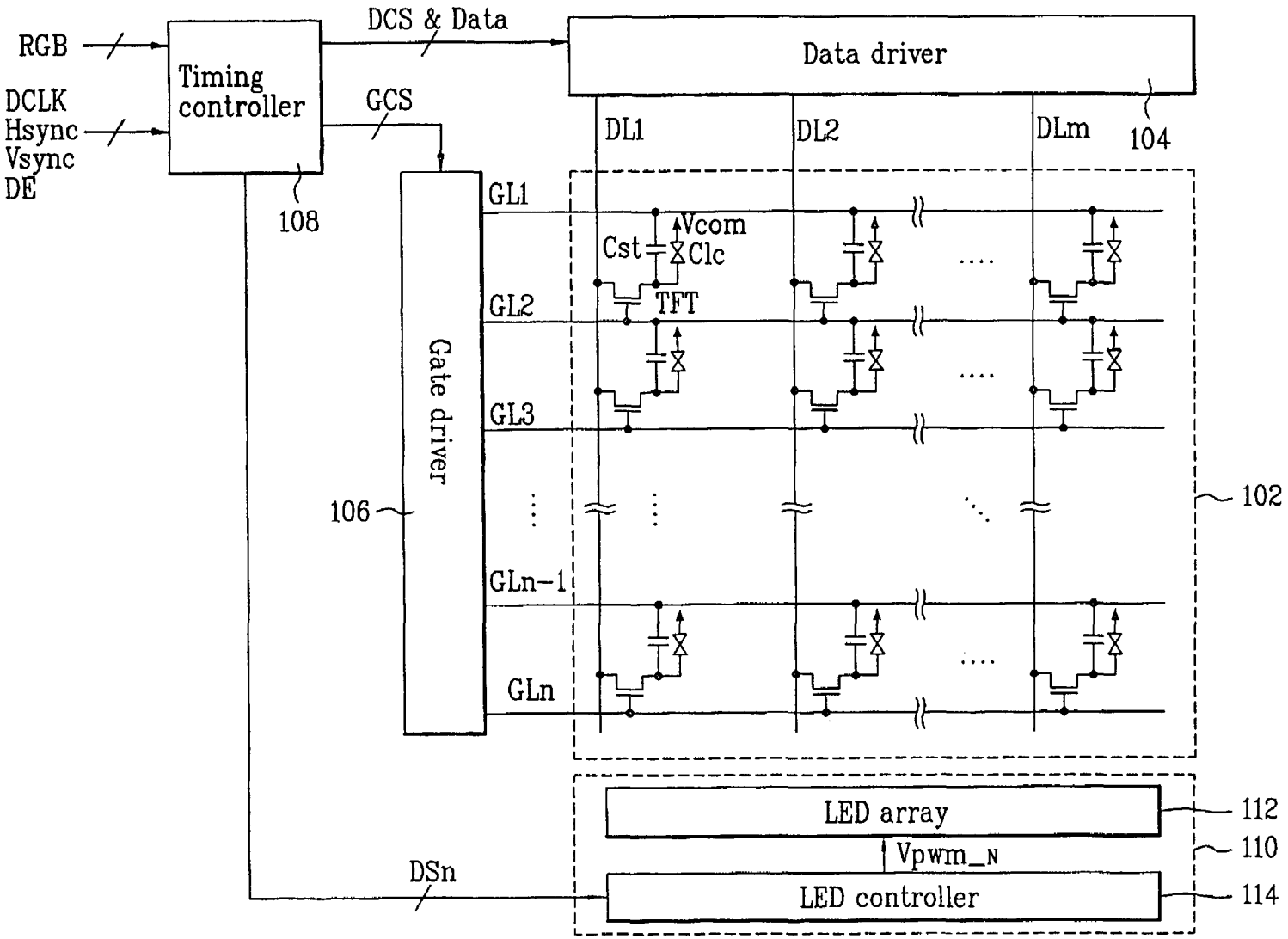
FIG. 3 is a schematic of an apparatus for driving an LCD device according to an embodiment of the invention.

FIG. 3 is a schematic of an apparatus for driving an LCD device according to an embodiment of the invention. Referring to FIG. 3, the apparatus according to embodiments of the invention includes an LCD panel 102 having liquid crystal cells formed in respective regions defined by a plurality of gate lines (GL1 to GLn) and a plurality of data lines (DL1 to DLm), a data driver that supplies analog video signals to the data lines (DL1 to DLm), a gate driver 106 that supplies scan signals to the gate lines (GL1 to GLn), a timing controller 108 that controls the data and gate drivers 104 and 106 while also generating a plurality of dimming signals (DSn) by resetting a dimming curve in accordance with input data (RGB), and an LED backlight unit 110 that respectively drives LED groups in accordance with each dimming signal (DSn) and applies light generated from the LED groups to the LCD panel 102.

The LCD panel 102 is provided with a thin film transistor array substrate bonded to a color filter array substrate, a spacer to maintain a cell gap between the two substrates, and a liquid crystal layer formed in a space formed by the spacer. The LCD panel 102 includes a thin film transistors (TFT) that are formed in liquid crystal cell regions defined by the gate lines (GL1 to GLn) and the data lines (DL1 to DLm). Each liquid crystal cell region is a sub-pixel and at least three sub-pixels form one unit pixel.

The TFTs provide the analog video signals supplied from the data lines (DL1 to DLm) to the liquid crystal cells in response to scan signals supplied from the gate lines (GL1 to GLn). Each liquid crystal cell can be equivalently expressed as a liquid crystal capacitor (Clc) because it is provided with a liquid crystal layer between a common electrode and a pixel electrode, which is connected to the TFT. This liquid crystal cell also includes a storage capacitor (Cst) that maintains the analog video signal charged on the liquid crystal capacitor (Clc) until the next analog video signal is charged thereon.

Figure 4:
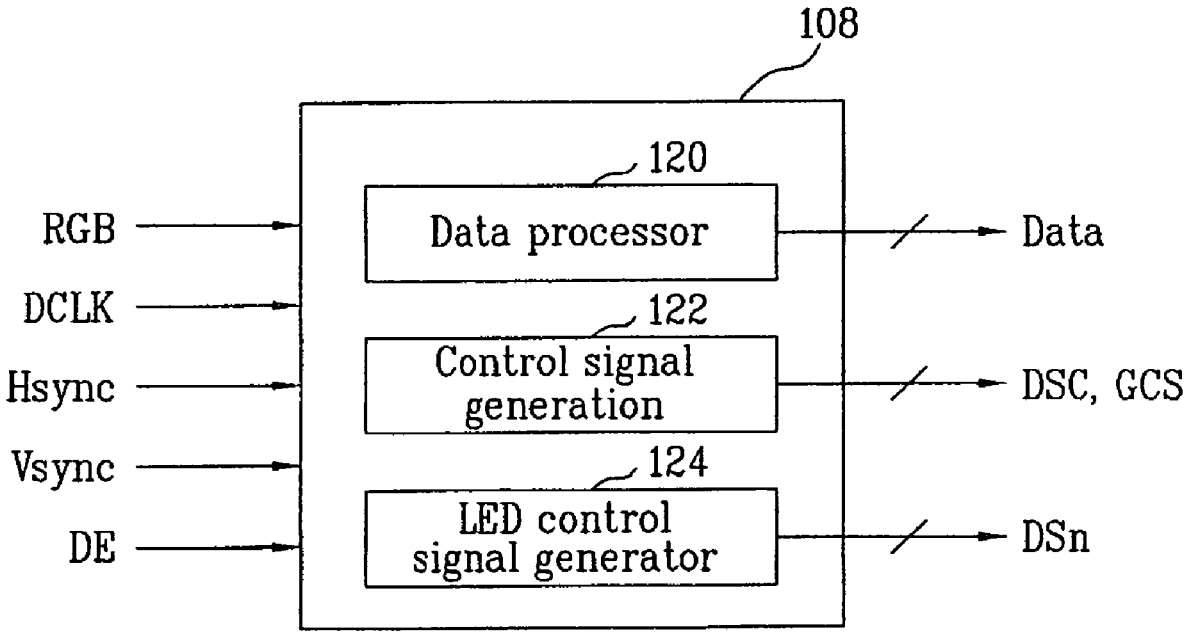
FIG. 4 is a block diagram of illustrating the timing controller of FIG. 3.

FIG. 4 is a block diagram of illustrating the timing controller of FIG. 3. As shown in FIG. 4, the timing controller 108 includes a data processor 120 that provides input data (RGB) to the data driver 104, a control signal generator 122 that generates control signals (DCS and GCS) to control the data driver 104 and the gate driver 106, and an LED control signal generator 124 that generates the plurality of dimming signals (DSn) to control the LED backlight unit 110. The data processor 120 arranges the input data (RGB) from externally received data to be appropriate for driving the LCD panel 102, and then provides the arranged data signal (Data) to the data driver 104 by a bus line. The control signal generator 122 generates the data control signal (DCS) including a source start pulse (SSP), a source shift clock (SSC), a polarity signal (POL), and a source output enable signal (SOE) by using a dot clock (DCLK), a data enable signal (DE), and horizontally and vertically synchronized signals (Hsync and Vsync), and then supplies the generated data control signal (DCS) to the data driver 104. Also, the control signal generator 122 generates the gate control signals (GCS) including a gate start pulse (GSP), a gate shift clock (GSC), and a gate output signal (GOE) by using a data enable signal (DE), and horizontally and vertically synchronized signals (Hsync, Vsync), and then supplies the generated gate control signals (GCS) to the gate driver 106.

Figure 5:
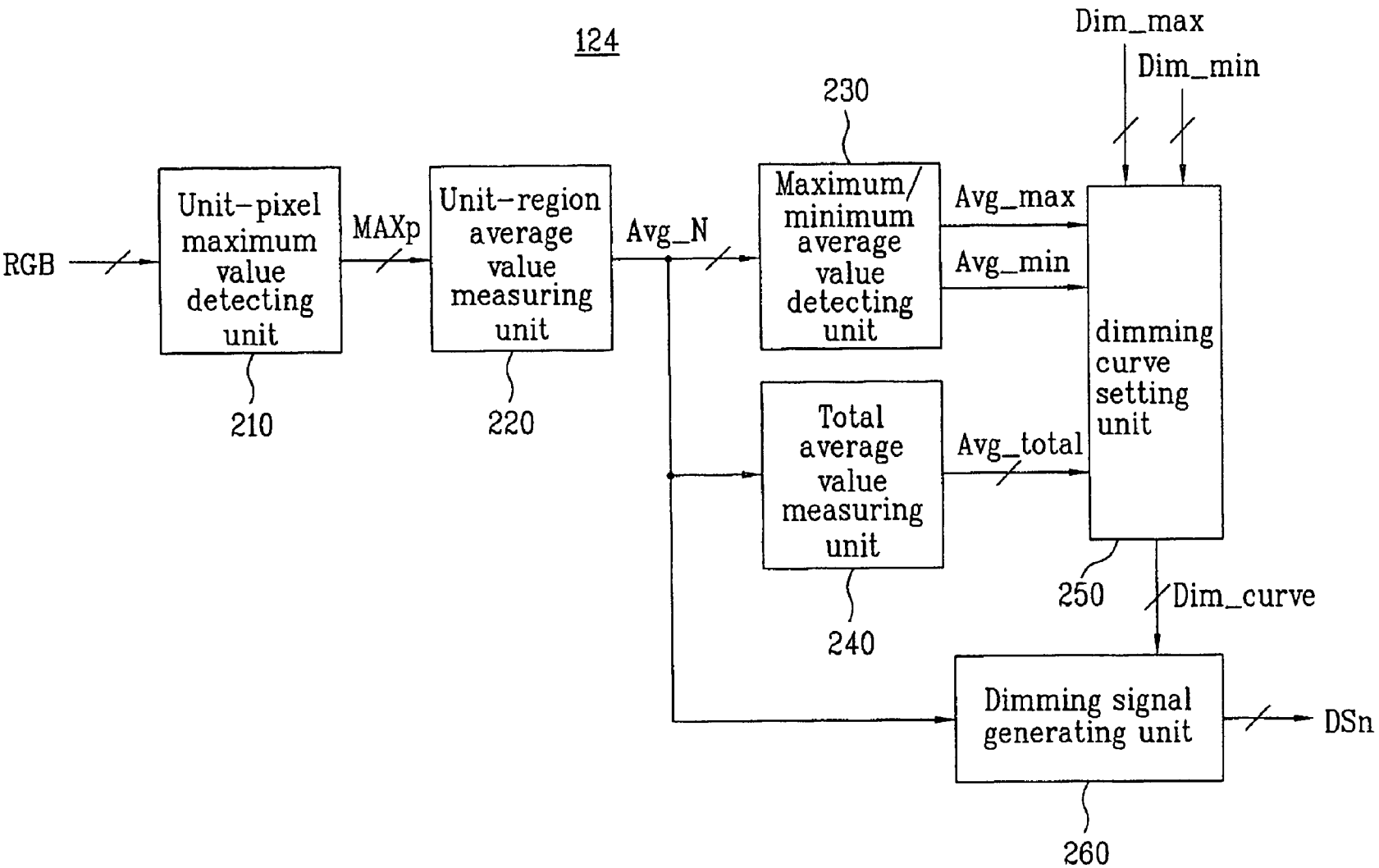
FIG. 5 is a block diagram illustrating the LED control signal generator in FIG. 4.

FIG. 5 is a block diagram illustrating the LED control signal generator in FIG. 4. As shown in FIG. 5, the LED control signal generator 124 includes a unit-pixel maximum value detecting unit 210, a unit-region average value measuring unit 220, a maximum/minimum average value detecting unit 230, a total average value measuring unit 240, a dimming curve setting unit 250, and a dimming signal generating unit 260. The unit-pixel maximum value detecting unit 210 detects a maximum gray-scale value of the input data (RGB) supplied to each pixel of the LCD panel 102 by each frame, to thereby provide a unit-pixel maximum value (MAXp). Then, the unit-pixel maximum value (MAXp) is supplied to the unit-region average value measuring unit 220. For example, if the red, green and blue data (RGB) values supplied to each pixel correspond to 255, 250, and 245, the unit-pixel maximum value (MAXp) is 255.

Figures 6, 7:
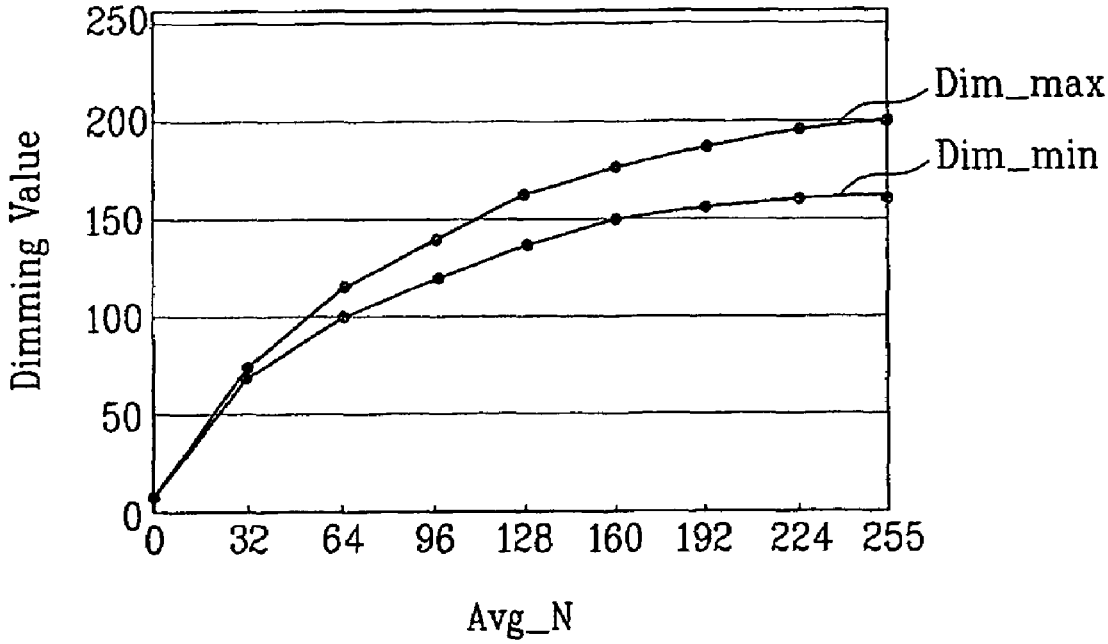
FIG. 6 illustrates divided regions of an LCD panel to measure an average value for each region by the unit-region average value measuring unit of FIG. 5.
FIG. 7 is a graph of illustrating minimum and maximum dimming curve values supplied to the dimming curve setting unit shown in FIG. 5.

FIG. 6 illustrates divided regions of an LCD panel to measure an average value for each region by the unit-region average value measuring unit of FIG. 5. As shown in FIG. 6, the unit-region average value measuring unit 220 divides one frame into n regions, and detects an average value for each divided region. Thus, the unit-region average value measuring unit 220 accumulates the unit-pixel maximum value (MAXp) supplied to each divided region from the unit-pixel maximum value detecting unit 210, and then measures the average value (Avg_N) for each divided region. The average value (Avg_N) for each divided region is then supplied to the maximum/minimum average value detecting unit 230, the total average value measuring unit 240, and the dimming signal generating unit 260.

The maximum/minimum average value detecting unit 230 detects the maximum average value (Avg_max) and the minimum average value (Avg_min) among the average values (Avg_N) of the respective regions supplied from the unit-region average value measuring unit 220, and then supplies the detected maximum and minimum average values (Avg_max, Avg_min) to the dimming curve setting unit 250.

The total average value measuring unit 240 accumulates the average value (Avg_N) for each region supplied from the unit-region average value measuring unit 220, and detects the total average value (Avg_total) for one frame. The total average value (Avg_total) for one frame is supplied to the dimming curve setting unit 250.

The dimming curve setting unit 250 sets a new dimming curve (Dim_curve) which is mapped between the maximum and minimum dimming curve values (Dim_max, Dim_min) by using the total number of divided regions (N), the total average value (Avg_total), the maximum average value (Avg_max), and the minimum average value (Avg_min), as shown in the following equation 1.

$$\text{Dim_curve} = \frac{\text{Dim_max} - \text{Dim_min}}{N} \times \frac{\text{Avg_max} - \text{Avg_min}}{\text{Avg_total}} + \text{Dim_min} \quad \text{[equation 1]}$$

In '(Avg_max−Avg_min)/Avg_total' of the above equation 1, the difference between the maximum average value (Avg_max) and the minimum average value (Avg_min) shows the brightness characteristic of the current image, which is in proportion to the driving condition of a partial peak of the image. If the image is totally bright, the total average value (Avg_total) for one frame is inversely proportional to the driving condition of partial peak of the image so as to make the brightness of image dark. The induction process of the new dimming curve (Dim_curve), which is mapped between the minimum and maximum dimming curve values (Dim_min, Dim_max) can be determined based on equation 1.

Figure 8:
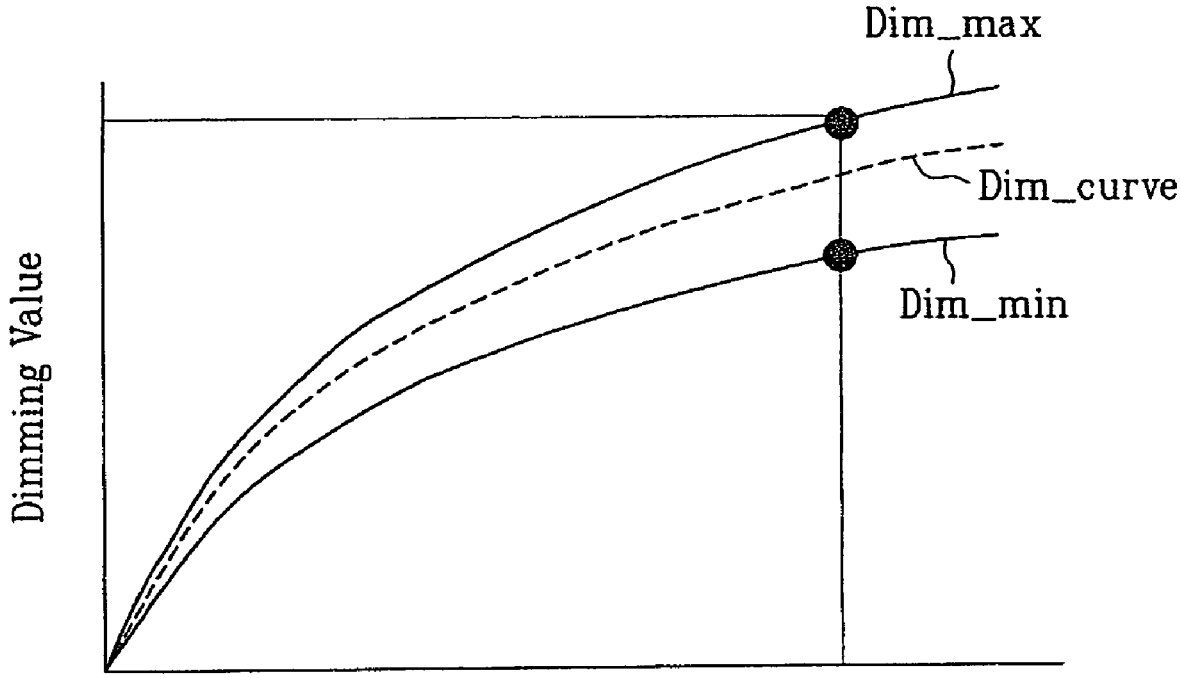
FIG. 8 is a graph of illustrating a dimming curve reset in a dimming curve setting unit shown in FIG. 5.

FIG. 7 is a graph of illustrating minimum and maximum dimming curve values supplied to the dimming curve setting unit shown in FIG. 5. As shown in FIG. 7, the minimum and maximum dimming curve values (Dim_min, Dim_max) are set by the minimum and maximum brightness characteristic of the LED backlight unit 110. FIG. 8 is a graph of illustrating a dimming curve reset in a dimming curve setting unit shown in FIG. 5. The LED control signal generator 124 analyzes the input data (RGB) by each frame, and resets the new dimming curve (Dim_curve) which is mapped between the maximum dimming curve value (Dim_max) and the minimum dimming curve value (Dim_min) by each frame in accordance with the distribution of brightness, as shown in FIG. 8. Also, the LED control signal generator 124 maps the average value (Avg_N) for each divided region in the new dimming curve (Dim_curve), and generates n dimming signals (DSn) to control the brightness for each divided region. The new dimming curve (Dim_curve) can be set to partially emphasize the image by using the LED backlight unit 110.

Figure 11:
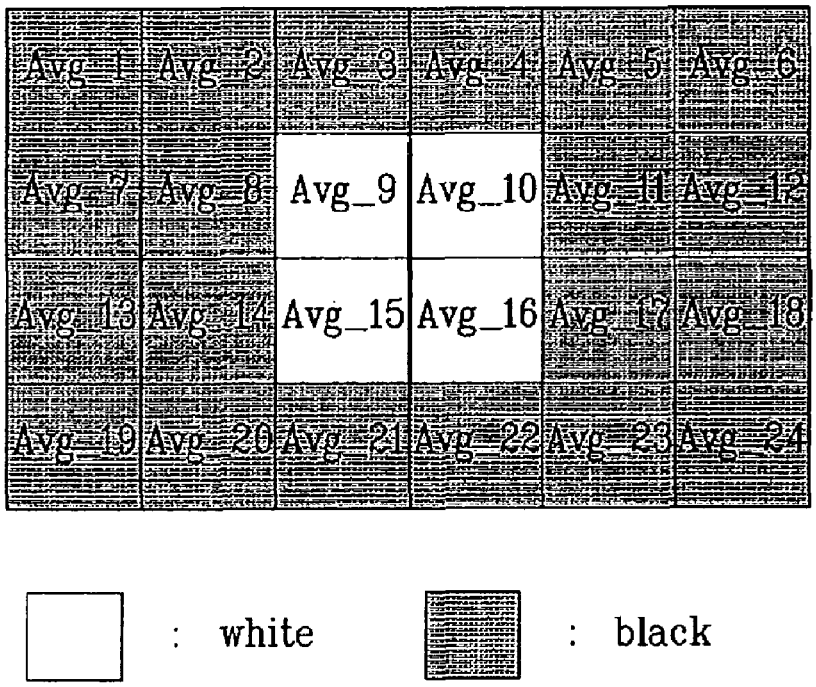

FIGS. 9 to 11 are exemplary views of illustrating images to reset a dimming curve by the dimming curve setting unit of FIG. 5. As shown in FIG. 9, in the case of the full-white image, since the dimming curve (Dim_curve) is set as the minimum dimming curve value (Dim_min), the LED backlight unit 110 can be controlled with the lowest dimming curve, so that it is possible to decrease power consumption. That is, in case of the full-white image, the LED backlight unit 110 is controlled such that the dimming curve (Dim_curve) is set as the low dimming value due to the entire image being bright.

As shown in FIG. 10, if the white image is displayed in only one divided region (spatial peak image), the dimming curve (Dim_curve) is set as the maximum dimming curve value (Dim_max), whereby the LED backlight unit 110 is controlled with the highest dimming curve, to thereby partially emphasize the brightness on image. That is, if displaying the spatial peak image, the peak portion is brightly dimmed at its maximum, to thereby increase the brightness contrast to be similar to a CRT. At this time, in the case of the low gray scale, the maximum dimming curve (Dim_max) and the minimum dimming curve (Dim_min) are very similar so that the dimming of the dark region is identical in the maximum and minimum dimming curves.

As shown in FIG. 11, if the white image is only displayed in one or more divided regions, the LED backlight unit 110 is controlled such that the dimming curve (Dim_curve) is set between the maximum dimming curve value (Dim_max) and the minimum dimming curve value (Dim_min), as shown in the above equation 1, so that it is possible to improve the picture quality by partially emphasizing the brightness of image.

In equation 1 above, the range of '(Avg_max−Avg_min)/Avg_total' to set the new dimming curve (Dim_curve) can be represented as the following equation 2.

$$\frac{\text{Avg_max} - \text{Avg_min}}{\dfrac{\left(\begin{array}{c}\text{Avg_1} + \text{Avg_2} + \ldots + \text{Avg_max} + \\ \text{Avg_min} + \ldots + \text{Avg_N}\end{array}\right)}{N}} \leq \frac{\text{Avg_max} - \text{Avg_min}}{\dfrac{\text{Avg_max} + \text{Avg_min}}{N}} \leq N \qquad \text{[equation 2]}$$

In the above equation 2, the maximum value of '(Avg_max−Avg_min)/Avg_total' corresponds to n. When the average value for each divided region corresponds to '0', the total average value (Avg_total) corresponds to '0'. Also, if '0' is obtained as a hardware, '(Avg_max−Avg_min)/Avg_total' is processed as '1'. Also, the minimum value of '(Avg_max−Avg_min)/Avg_total' is '0' since the minimum average value (Avg_min) becomes the maximum average value (Avg_max). Accordingly, the following equation 3 can be obtained by multiplying the total division number n and '(Avg_max−Avg_min)/Avg_total', and normalizing the multiplied result.

$$0 \leq \frac{\text{Avg_max} - \text{Avg_min}}{\text{Avg_total} \times N} \leq 1 \qquad \text{[equation 3]}$$

By multiplying equation 3 by the difference between the maximum dimming curve value (Dim_max) and the minimum dimming curve value (Dim_min), equation 4 can be obtained as follows.

$$0 \leq \frac{\text{Dim_max} - \text{Dim_min}}{N} \times \frac{\text{Avg_max} - \text{Avg_min}}{\text{Avg_total}} \leq \text{Dim_max} - \text{Dim_min} \qquad \text{[equation 4]}$$

When the minimum dimming curve value (Dim_min) is added to equation 4 so as to map the new dimming curve (Dim_curve) between the maximum dimming curve value (Dim_max) and the minimum dimming curve value (Dim_min), equation 5 can be obtained as follows.

$$\text{Dim_min} \leq \frac{\text{Dim_max} - \text{Dim_min}}{N} \times \frac{\text{Avg_max} - \text{Avg_min}}{\text{Avg_total}} + \text{Dim_min} \leq \text{Dim_max} \qquad \text{[equation 5]}$$

For example, as shown in FIG. 9, if displaying a full-white image on the LCD panel 102 which is divided into 24 regions, the dimming curve (Dim_curve) set by the dimming curve setting unit 250 has the minimum dimming curve value (Dim_min) shown in the following equation 6.

$$\text{Dim_curve} = \frac{\text{Dim_max} - \text{Dim_min}}{24} \times \frac{255 - 255}{255} + \text{Dim_min} \qquad \text{[equation 6]}$$

$$\therefore \text{Dim_curve} = \text{Dim_min}$$

Also, as shown in FIG. 10, if the white image is displayed on one divided region of the LCD panel 102 which is divided into 24 regions, and the black image is displayed on the other divided regions of the LCD panel 102, the dimming curve (Dim_curve) set by the dimming curve setting unit 250 has the maximum dimming curve value (Dim_max) shown in the following equation 7.

$$\text{Dim_curve} = \frac{\text{Dim_max} - \text{Dim_min}}{24} \times \frac{255 - 0}{255/24} + \text{Dim_min} \qquad \text{[equation 7]}$$

$$\therefore \text{Dim_curve} = \text{Dim_max}$$

As shown in FIG. 11, if the white image is displayed on four divided regions of the LCD panel 102 which is divided into 24 regions, and the black image is displayed on the other divided regions of the LCD panel 102, the dimming curve (Dim_curve) set by the dimming curve setting unit 250 is mapped to have the predetermined value between the maximum dimming curve value (Dim_max) and the minimum dimming curve value (Dim_min), as shown, in the following equation 8.

$$\text{Dim_curve} = \frac{\text{Dim_max} - \text{Dim_min}}{24} \times \frac{255 - 0}{\dfrac{255 \times 4}{24}} + \text{Dim_min} \qquad \text{[equation 8]}$$

$$\therefore \text{Dim_curve} = \frac{\text{Dim_max}}{4} + \frac{3 \times \text{Dim_min}}{4}$$

The dimming signal generating unit 260 generates n dimming signals (DSn) corresponding to the average value (Avg_N) for each region supplied from the unit-region average value measuring unit 220 in the dimming curve (Dim- _curve) reset by the dimming curve setting unit 250, and then supplies the generated dimming signals (DSn) to the LED backlight unit 110.

Referring back to FIG. 3, the gate driver 106 includes a shift register which sequentially generates the scan signal, that is, a gate high signal in accordance with the gate control signal (GCS) supplied from the timing controller 108. The gate driver 106 sequentially supplies the gate high signal to the gate lines (GL) of the LCD panel 102, whereby the TFT connected with the gate line (GL) is turned-on.

The data driver 104 converts the data signal (Data) arranged in the timing controller 108 to the analog video signal in accordance with the data control signal (DCS) supplied from the timing controller 108, and supplies the analog video signal for one horizontal line to the data lines (DL) by one horizontal period for supplying the scan signal to the gate line (GL). That is, the data driver 104 selects a gamma voltage having a predetermined level based on the gray scale value of the data signal (Data), and supplies the selected gamma voltage to the data lines (DL1 to DLm). At this time, the data driver 104 inverts the polarity of the analog video signal supplied to the data line (DL) in response to a polarity control signal (POL).

The LED backlight unit 110 includes an LED array 112, which is divided into n regions, and is provided with n LED groups; and an LED controller 114 which respectively drives the n LED groups in accordance with the n dimming signals (DSn) supplied from the timing controller 108.

Figure 12:
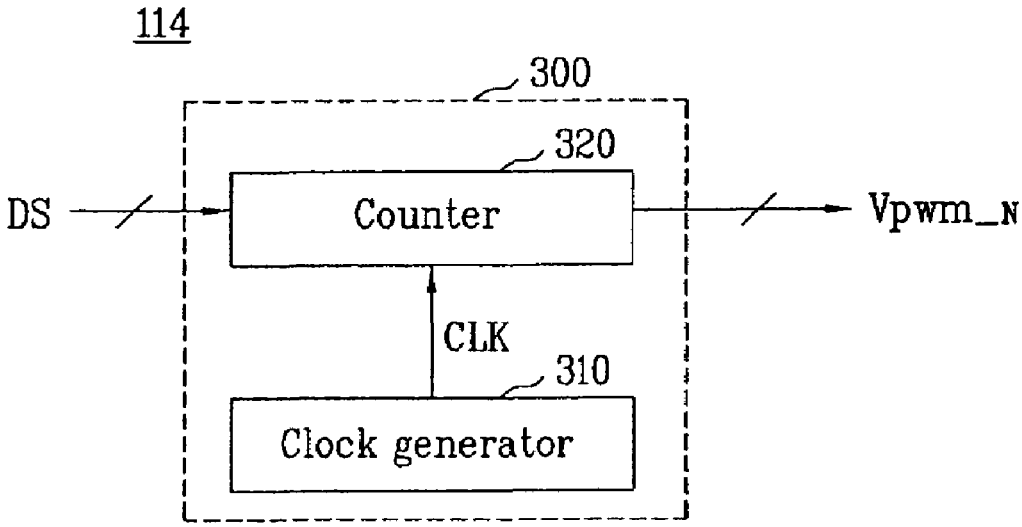
FIG. 12 is a block diagram of illustrating an LED controller shown in FIG. 3.
Figure 13:
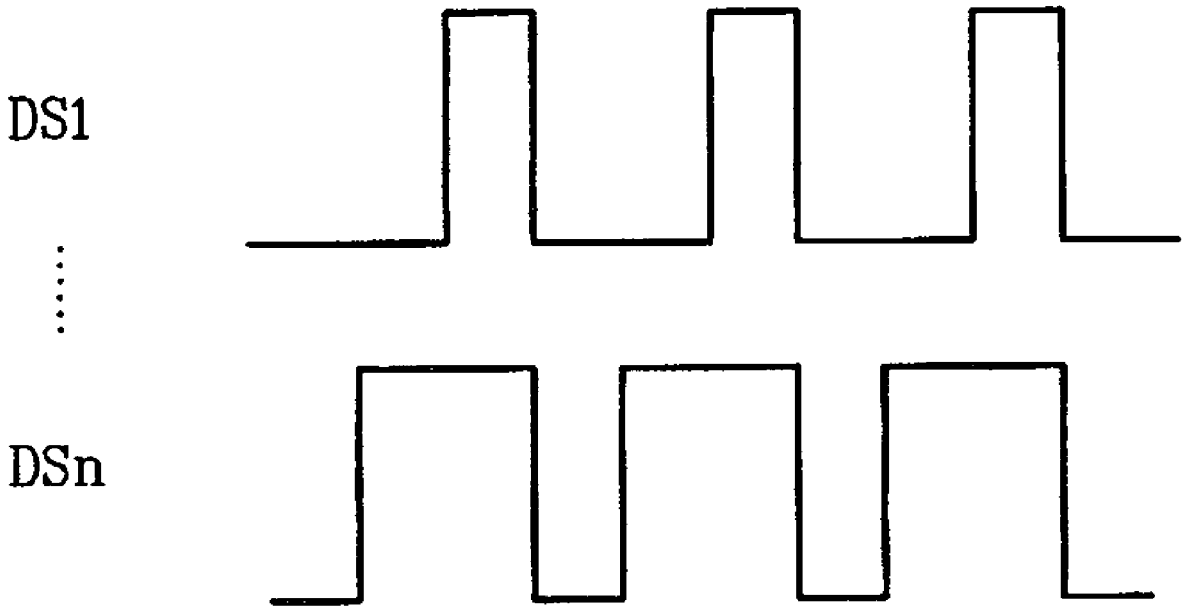
FIG. 13 is a waveform diagram of illustrating a plurality of pulse-width modulation signals generated in the LED controller of FIG. 12.

The LED controller 114 generates a pulse-width modulation signal (Vpwm_N) corresponding to each of the n dimming signals (DSn), and supplies the generated pulse-width modulation signal (Vpwm_N) to the LED array 112 which is divided into n regions. FIG. 12 is a block diagram of illustrating an LED controller shown in FIG. 3. FIG. 13 is a waveform diagram of illustrating a plurality of pulse-width modulation signals generated in the LED controller of FIG. 12. As shown in FIG. 12, the LED controller 114 includes a plurality of pulse-width modulating units 300, each having a clock generator 310 and a counter 320. The clock generator 310 generates the clock signal (CLK) having a predetermined period, and supplies the generated clock signal (CLK) to the counter 320. Then, the counter 320 counts the clock signal (CLK) corresponding to the dimming signal (DSn), and generates the plurality of pulse-width modulation signals (Vpwm_N) corresponding to the dimming signal (DSn), as shown in FIG. 13.

The LED array 112 which is divided into n regions includes the n LED groups which are respectively arranged in the n divided regions in opposite to the rear surface of the LCD panel 102. The LED groups of n number are provided with the plurality of red, green and blue LEDs arranged repeatedly, wherein the plurality of red, green and blue LEDs are provided in the respective divided regions of n number. The LEDs provided in each of the LED groups are driven in accordance with the pulse-width modulation signal (Vpwm_N) supplied from the LED controller 114 such that the light generated from the LEDs is applied to the rear surface of the LCD panel 102 corresponding to each divided region.

In the above apparatus for driving the LCD device according to the present invention, the scan signal is supplied to each gate line (GL); the input data (RGB) is converted into the analog video signal, and is then supplied to each data line (DL) in synchronization with the scan signal to thereby drive the liquid crystal cell; the new dimming curve (Dim_curve) is reset based on the input data (RGB); the plurality of dimming signals (DSn) are generated based on the average value (Avg_N) for each divided region; the plurality of LED groups are respectively driven based on the dimming signals (DSn); and the LCD panel 102 corresponding to each divided region is illuminated with the light generated from the LED groups.

Figure 14:
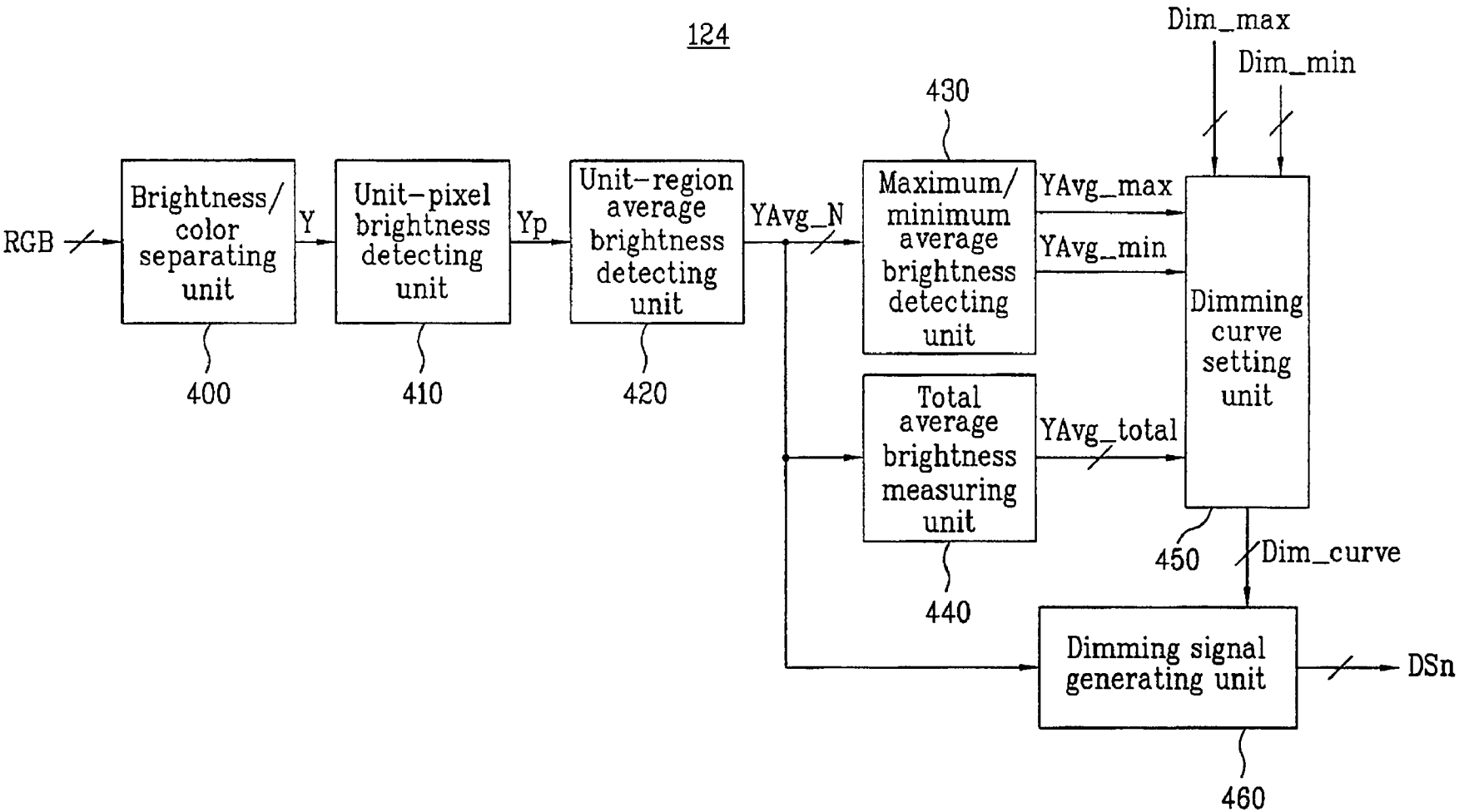
FIG. 14 is a block diagram of illustrating an LED control signal generator according to another embodiment of the invention.

FIG. 14 is a block diagram of illustrating an LED control signal generator according to another embodiment of the invention. Referring to FIG. 14, the LED control signal generator 124 includes a brightness/color separating unit 400, a unit-pixel brightness detecting unit 410, a unit-region average brightness detecting unit 420, a maximum/minimum average brightness detecting unit 430, a total average brightness measuring unit 440, a dimming curve setting unit 450, and a dimming signal generating unit 460. The brightness/color separating unit 400 separates the input data (RGB) into brightness components (Y) and color components (U, V).

The brightness components (Y) and the color components (U, V) can be obtained by the following equations 9 to 11.

$$Y=0.299\times Ri+0.587\times Gi+0.114\times Bi \quad \text{[equation 9]}$$

$$U=0.493\times(Bi-Y) \quad \text{[equation 10]}$$

$$V=0.887\times(Ri-Y) \quad \text{[equation 11]}$$

The unit-pixel brightness detecting unit 410 detects the brightness components (Yp) supplied to each pixel of the LCD panel 102 from the brightness/color separating unit 400. As shown in FIG. 6, the unit-region average brightness detecting unit 420 divides one frame into n regions, and detects the average brightness (YAvg_N) for each divided region in accordance with the brightness component (Yp) for each pixel supplied from the unit-pixel brightness detecting unit 410. That is, the unit-region average brightness detecting unit 420 accumulates the brightness components (Yp) for the all pixels of the divided region, and measures the average brightness (YAvg_N) for each region. The average brightness for each region (YAvg_N) is supplied to the maximum/minimum average brightness detecting unit 430, the total average brightness measuring unit 440, and the dimming signal generating unit 460.

The maximum/minimum average brightness detecting unit 430 detects the maximum average brightness (YAvg_max) and the minimum average brightness (YAvg_min) for each region supplied from the unit-region average brightness detecting unit 420, and supplies the maximum and minimum average brightness to the dimming curve setting unit 450.

The total average brightness measuring unit 440 accumulates the average brightness for each region, supplied from the unit-region average brightness detecting unit 420, and detects the total average brightness (YAvg_total) for one frame. The total average brightness for one frame (YAvg_total) is supplied to the dimming curve setting unit 450.

The dimming curve setting unit 450 sets the new dimming curve (Dim_curve) between the minimum and maximum dimming curve values (Dim_min, Dim_max) inputted by using the total number of divided regions (N), the total average brightness value (YAvg_total), the maximum average brightness value (YAvg_max), and the minimum average brightness value (YAvg_min).

$$\text{Dim_curve}=\frac{\text{Dim_max}-\text{Dim_min}}{N}\times\frac{\text{YAvg_max}-\text{YAvg_min}}{\text{YAvg_total}}+\text{Dim_min} \quad \text{[equation 12]}$$

The dimming signal generating unit 460 generates the n dimming signals (DSn) corresponding to the average brightness value (YAvg_N) for each region, supplied from the unit-region average brightness detecting unit 420, in the dimming curve (Dim_curve) reset and supplied from the dimming curve setting unit 450, and supplies the generated dimming signals (DSn) to the LED backlight unit 110.

The LED control signal generator 124 analyzes the input data (RGB) by each frame, and resets the new dimming curve (Dim_curve) which is mapped between the maximum dimming curve value (Dim_max) and the minimum dimming curve value (Dim_min) by each frame in accordance with the distribution of brightness, as shown in FIG. 8. Also, the LED control signal generator 124 maps the average value (Avg_N) for each divided region in the new dimming curve (Dim_curve), and generates n dimming signals (DSn) to control the brightness for each divided region. At this time, the new dimming curve (Dim_curve) can be set to partially emphasize the image by using the LED backlight unit 110.

Accordingly, the apparatus for driving the LCD device according to embodiments of the invention displays the image corresponding to the input data to the LCD panel by controlling the transmittance of light generated from the LED backlight unit through the liquid crystal cell driven by the analog video signal. Further, in embodiments of the invention, it is possible to partially emphasize the brightness of image with the LED backlight unit by appropriately resetting the new dimming curve, which is mapped between the maximum dimming curve value and the minimum dimming curve value, in accordance with the maximum gray-scale value or brightness of the input data (RGB) being supplied to each pixel by each frame. By controlling the LED backlight in correspondence to the input data, the picture quality of the LCD panel can be improved and power consumption can be decreased.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. An apparatus for driving a liquid crystal display device comprising:

a liquid crystal display panel having liquid crystal cells in respective regions defined by a plurality of gate and data lines;

a data driver providing video signals to the data lines;

a gate driver providing scan signals to the gate lines;

a timing controller controlling the gate and data drivers, and generates a plurality of dimming signals by resetting a dimming curve in accordance with input data; and a light emitting diode backlight unit driving light emitting diode groups in accordance with the plurality of dimming signals to provide light to the liquid crystal display panel.

2. The apparatus of claim 1, wherein the timing controller includes:

a data processor arranging the input data and then supplies the arranged input data to the data driver;

a control signal generator generating control signals to control the data and gate drivers; and a light emitting diode control signal generator generating the plurality of dimming signals.

3. The apparatus of claim 2, wherein the light emitting diode control signal generator includes:

a unit-pixel maximum value detecting unit detecting a maximum gray-scale value of the input data supplied to each pixel;

a unit-region average value measuring unit dividing data of one frame into a plurality of regions and measures an average value of unit-pixel maximum gray-scale values in each divided region;

a maximum/minimum average value detecting unit detecting maximum and minimum average values from the average value for each divided region;

a total average value measuring unit measuring a total average value from the average value for each divided region;

a dimming curve setting unit resetting the dimming curve based on the total average value, maximum average value, minimum average values, and the minimum and maximum dimming curve values set and input externally; and a dimming signal generating unit generating the plurality of dimming signals corresponding to the average value for each divided region from the dimming curve reset by the dimming curve setting unit.

4. The apparatus of claim 3, wherein the dimming curve setting unit resets the dimming curve based on an equation of {((maximum dimming curve value−minimum dimming curve value)/total number of divided regions)×((maximum average value−minimum average value)/total average value)+minimum dimming curve value}.

5. The apparatus of claim 4, wherein the dimming curve set by the dimming curve setting unit is any one of the maximum dimming curve value, the minimum dimming curve value, and a predetermined value between the minimum and maximum dimming curve values in accordance with the input data.

6. The apparatus of claim 3, wherein the light emitting diode backlight unit includes:

a light emitting diode array having a plurality of light emitting diode groups that respectively correspond to the divided regions; and a light emitting diode controller driving the respective light emitting diode groups in accordance with the plurality of dimming signals.

7. The apparatus of claim 6, wherein the light emitting diode controller includes a plurality of pulse-width modulating units that generate a plurality of pulse-width modulation signals corresponding to each of the plurality of dimming signals by counting the clock signal having a predetermined period, and drives the light emitting diode groups with the generated pulse-width modulation signals.

8. The apparatus of claim 2, wherein the light emitting diode control signal generator includes:

a brightness/color separating unit separating the input data into brightness components and color components;

a unit-pixel brightness detecting unit detecting the brightness components supplied to each pixel;

a unit-region average brightness detecting unit dividing the data of one frame into the plurality of regions, and detects the average brightness of brightness components for each pixel in the divided region;

a maximum/minimum average brightness detecting unit detecting maximum and minimum average brightness from the average brightness for each divided region;

a total average brightness measuring unit measuring a total average brightness from the average brightness for each divided region;

a dimming curve setting unit resetting the dimming curve based on the total average brightness, maximum average brightness, minimum average brightness, and the minimum and maximum dimming curve values set and input externally; and a dimming signal generating unit generating the plurality of dimming signals corresponding to the average brightness for each divided region from the dimming curve reset by the dimming curve setting unit.

9. The apparatus of claim 8, wherein the dimming curve setting unit resets the dimming curve based on an equation of {((maximum dimming curve value−minimum dimming curve value)/total number of divided regions)×((maximum average brightness−minimum average brightness)/total average brightness)+minimum dimming curve value}.

10. The apparatus of claim 9, wherein the dimming curve set by the dimming curve setting unit is any one of the maximum dimming curve value, the minimum dimming curve value, and a predetermined value between the minimum and maximum dimming curve values in accordance with the input data.

11. The apparatus of claim 8, wherein the light emitting diode backlight unit includes:

a light emitting diode array having a plurality of light emitting diode groups respectively corresponding to the divided regions; and a light emitting diode controller driving the light emitting diode groups in accordance with the plurality of dimming signals.

12. The apparatus of claim 11, wherein the light emitting diode controller includes a plurality of pulse-width modulating units that generate a plurality of pulse-width modulation signals corresponding to each of the plurality of dimming signals by counting the clock signal having a predetermined period, and drives the light emitting diode groups with the generated pulse-width modulation signals.

13. A method for driving a liquid crystal display device with a liquid crystal display panel having liquid crystal cells formed in respective regions defined by a plurality of gate and data lines, comprising:

generating a plurality of dimming signals by resetting a dimming curve in accordance with input data;

supplying scan signals to the gate line, and converting the input data into video signals and then supplying the video signals to the data line in synchronization with the scan signals; and driving a plurality of light emitting diode groups in accordance with the plurality of dimming signals to provide light to the liquid crystal display panel.

14. The method of claim 13, wherein the generating the plurality of dimming signals includes:

detecting a maximum gray-scale value of the input data supplied to each pixel;

dividing data of one frame into a plurality of regions and measuring an average value of unit-pixel maximum gray-scale values by each divided region;

detecting maximum and minimum average values from the average value for each divided region;

measuring a total average value from the average value for each divided region;

resetting the dimming curve based on the total average value, maximum average value, minimum average value, and the minimum and maximum dimming curve values set and input externally; and generating the plurality of dimming signals corresponding to the average value for each divided region from the dimming curve reset.

15. The method of claim 14, wherein the dimming curve is reset base on an equation of {((maximum dimming curve value−minimum dimming curve value)/total number of divided regions)×((maximum average value−minimum average value)/total average value)+minimum dimming curve value}.

16. The method of claim 15, wherein the dimming curve set is any one of the maximum dimming curve value, the minimum dimming curve value, and a predetermined value between the minimum and maximum dimming curve values in accordance with the input data.

17. The method of claim 14, wherein the driving the plurality of light emitting diode groups includes:

generating a plurality of pulse-width modulation signals corresponding to the respective dimming signals by counting the clock signal having a predetermined period; and supplying the generated pulse-width modulation signals to the light emitting diode groups provided in the divided regions to drive the light emitting diode groups.

18. The method of claim 13, wherein the generating the plurality of dimming signals includes:

separating the input data into brightness components and color components;

detecting the brightness components supplied to each pixel;

dividing the data of one frame into the plurality of regions, and detecting the average brightness of brightness components for each pixel of a divided region;

detecting maximum and minimum average brightness from the average brightness for each divided region;

measuring a total average brightness from the average brightness for each divided region;

resetting the dimming curve based on the total average value, maximum average value, minimum average value, and the minimum and maximum dimming curve values set and input externally; and generating the plurality of dimming signals corresponding to the average brightness for each divided region from the dimming curve reset.

19. The method of claim 18, wherein the dimming curve is based on an equation of {((maximum dimming curve value−minimum dimming curve value)/total number of divided regions)×((maximum average brightness−minimum average brightness)/total average brightness)+minimum dimming curve value}.

20. The method of claim 19, wherein the dimming curve set is any one of the maximum dimming curve value, the minimum dimming curve value, and a predetermined value between the minimum and maximum dimming curve values in accordance with the input data.

21. The method of claim 18, wherein the driving the plurality of light emitting diode groups includes:

generating a plurality of pulse-width modulation signals corresponding to the respective dimming signals by counting the clock signal having a predetermined period; and supplying the generated pulse-width modulation signals to the light emitting diode groups provided in the respective divided regions to drive the light emitting diode groups.

* * * * *